US007246478B2

(12) United States Patent
Fairfax

(10) Patent No.: US 7,246,478 B2
(45) Date of Patent: Jul. 24, 2007

(54) SADDLE

(75) Inventor: Vanessa Fairfax, Walsall (GB)

(73) Assignee: Thorowgood Limited, West Midlands (GB)

( * ) Notice: Subject to any disclaimer, the term of this patent is extended or adjusted under 35 U.S.C. 154(b) by 350 days.

(21) Appl. No.: 10/946,427

(22) Filed: Sep. 21, 2004

(65) Prior Publication Data

US 2005/0066630 A1 Mar. 31, 2005

(51) Int. Cl.
*B68C 1/20* (2006.01)
*B68C 1/02* (2006.01)

(52) U.S. Cl. ..... 54/44.1

(58) Field of Classification Search ..... 54/44.1, 54/44.3, 44.5, 44.7
See application file for complete search history.

(56) References Cited

U.S. PATENT DOCUMENTS

| | | | | |
|---|---|---|---|---|
| 270,142 | A * | 1/1883 | Spencer | 54/44.3 |
| 450,779 | A * | 4/1891 | Bernhard | 54/44.1 |
| 6,363,698 | B1 * | 4/2002 | Swain | 54/44.5 |
| 2001/0005980 | A1 | 7/2001 | Kempsell et al. | |

FOREIGN PATENT DOCUMENTS

| | | | |
|---|---|---|---|
| AU | 13076 83 | A | 10/1984 |
| EP | 0 764 606 | A1 | 3/1997 |
| FR | 2 162 760 | A | 7/1973 |
| GB | 2 279 546 | A | 1/1995 |
| WO | WO 00/35805 | | 6/2000 |

* cited by examiner

*Primary Examiner*—Rob Swiatek
(74) *Attorney, Agent, or Firm*—Kirschstein, et al.

(57) ABSTRACT

A European style horse riding saddle includes a tree with a downwardly depending point on each side adjacent the front thereof wherein there is provided on an outer accessible surface on each side of the saddle a pocket extending behind the respective point of the tree with an opening for receipt of an insert.

17 Claims, 3 Drawing Sheets

SADDLE

BACKGROUND TO THE INVENTION

The invention relates to horse riding saddles, and in particular to such saddles which are of European style and are readily adjustable in terms of their fit to the horse at the head of the saddle.

DESCRIPTION OF THE PRIOR ART

Conventionally European saddles are manufactured and sold in a range of styles and sizes. The different styles are intended to be suitable both for different uses, such as dressage, show-jumping or general purpose, and for different kinds of breed of horse which have very different conformations, e.g. thoroughbred, warmblood and cob. The different sizes are in particular in respect of the width of the gullet below the head of the saddle across the horse's withers (e.g. narrow, medium, wide, extra wide) and the length of the saddle from front to back (e.g. 430 mm, 460 mm, etc.).

It is extremely important that a saddle fits the horse wearing it correctly as badly fitting saddles can cause a wide range of problems such as lameness, a build up of scar tissue, and muscle wastage. Ideally saddles should be professionally fitted, but in many cases this is not practical for one reason or another. In addition horses often change their condition during the year as they are rested, brought into competitive condition, or are unwell, and thus a saddle which fits properly at one time may not fit properly at another, whether professionally fitted or not.

The size of the saddle at the head, i.e. the portion which fits across the horses withers and onto the shoulders, is determined by the tree and gullet insert (often called the gullet bar) around which the saddle is constructed. The tree is generally formed of relatively rigid material(s), e.g. wood, metal or plastics, and has points extending downwardly on either side at the front. The points may be rigid or slightly more flexible than the rest of the tree, and in some cases there are rigid points and additional flexible points. In any event it is the points which form the angle of the head of the saddle below the pommel.

The gullet insert is generally formed of steel and is secured underneath the front of the tree extending at least part of the way down the points thereof in order to maintain the arch of the pommel correctly. The combination of tree and gullet insert, in combination with the rest of the saddle constructed around them and the degree of padding included, establish the fit of saddle (e.g. narrow, medium, wide, extra wide).

Saddles have been produced in which the front of the saddle beneath the pommel can be opened to expose the underside of the front of the tree and the gullet insert and, as the gullet insert is screwed in place on the underside of the tree rather than riveted, the gullet insert can readily be changed to alter the fit of the saddle. This can be undertaken by the retailer in order to provide a customer with the fit of saddle they require, or the owner in order to allow for changes in condition of their horse. However, tools are required to accomplish the change of fit.

It is an object of the present invention to provide an alternative form of adjustable saddle.

SUMMARY OF THE INVENTION

According to the present invention there is provided a horse riding saddle including a tree with a downwardly depending point on each side adjacent the front thereof wherein there is provided on an outer accessible surface on each side of the saddle a pocket extending behind the respective point of the tree with an opening for receipt of an insert.

The invention provides the advantage that the fit of the saddle can be altered in a matter of moments without the need for any tools.

The pocket may conveniently be upwardly extending with a downward facing opening, alternatively the pocket may be rearwardly extending with a forward facing opening or forwardly extending with a rearward facing opening.

Preferably the opening to the pocket is provided with a closure to retain the insert in the pocket as required. Ideally, the closure does not require any tools to be opened and closed and this may be provided by hook and loop fastener.

Preferably a selection of inserts of different thicknesses is provided.

The inserts are preferably formed from a substantially incompressible material, but this might also be slightly flexible. This may conveniently be a plastics material.

Conveniently the inserts are of a generally oval shape with greatest thickness in a middle portion and tapering towards their edges.

In use the middle portion of the inserts is located directly beneath the points of the tree.

The inserts may be provided with a formation at the lower end thereof to assist in removing it from the pocket. The formations on the inserts may take the form of loops formed integrally with a main portion of the inserts. Alternatively the formations on the inserts may take the form of loops secured to the main portion of the inserts, in which case they may be formed of flexible fabric.

BRIEF DESCRIPTION OF THE DRAWINGS

An embodiment of a horse riding saddle according to the present invention will now be described, by way of example only, with reference to the accompanying drawings in which.

DESCRIPTION OF THE PREFERRED EMBODIMENT

Figure 1:
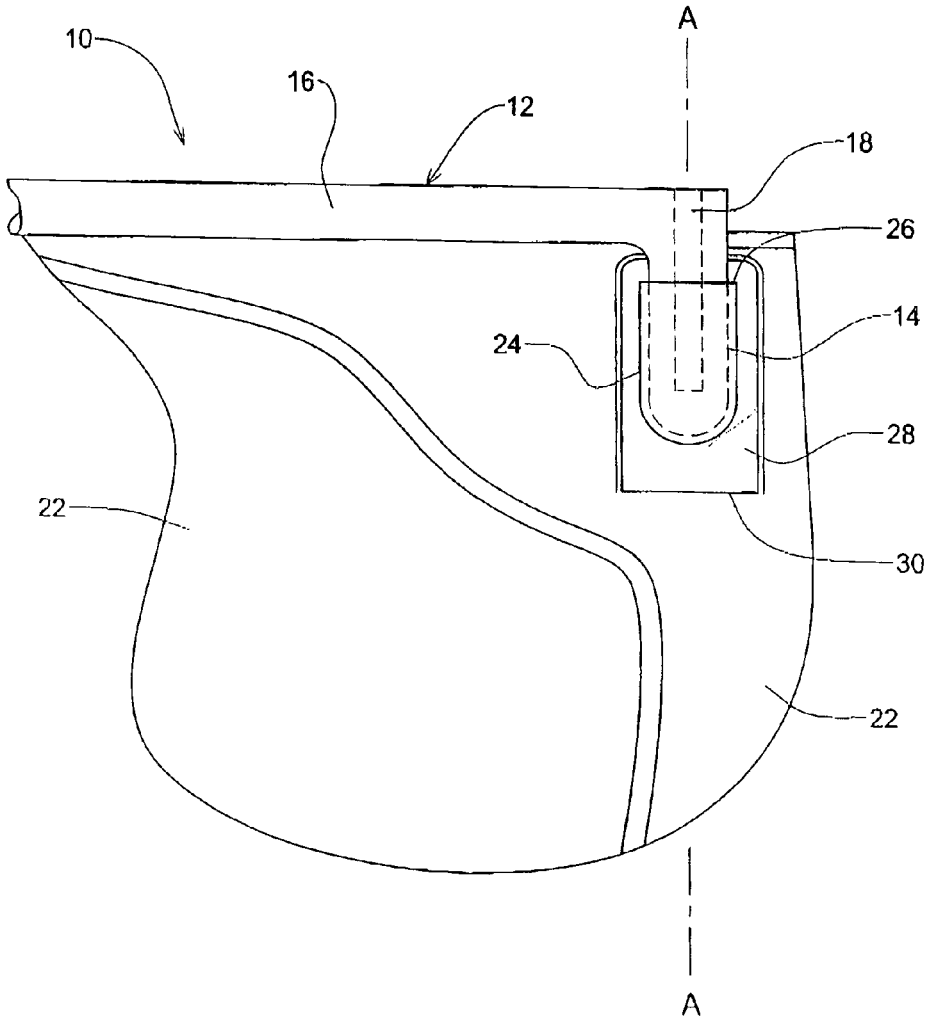
FIG. 1 is a simplified side view of a saddle according to the present invention, with the saddle flaps, seat cushioning and covering omitted.

Referring now to the figures, in which a European style horse riding saddle 10 according to the invention is illustrated in simplified form (with saddle flaps, seat cushioning and covering and other parts which will not be affected by the invention having been omitted for clarity), the invention will be explained. The saddle 10 includes a conventional tree 12 having a downwardly extending point 14 on either side at the front thereof and a seat portion 16. Underneath the front of the tree 12 is a gullet insert 18. The tree 12 is conveniently formed of plastics material, and the points 14 may be thinner than the rest of the tree 12 so that they have a degree of flexibility which the rest of the tree 12 does not have. The gullet insert 18 is generally formed of steel and helps to determine the width of the gullet (the arch under the pommel 20 of the saddle 10).

Beneath the tree 12 are located conventional stuffed panels 22 which are the parts of the saddle 10 which contact the horse's back when the saddle is in use. The points 14 of the tree 12 are located in downwardly extending pockets 24 which each have an upwardly facing opening 26, and which are located on the stuffed panels 22. It should be noted that seat cushioning and covering (known in the trade as seaming) attached to the top of the tree 12, such that the tree 12 is retained in its correct position with the points 14 in the pockets 26, have been omitted from the figures for clarity.

The saddle 10 also has upwardly extending pockets 28 which each have a downwardly facing opening 30. These upwardly extending pockets 28 are located beneath the downwardly extending pockets 24, but on the outer side of the stuffed panels 22. The openings 30 may conveniently be provided with a closure, such as hook and loop fastener, to retain the pockets closed when the saddle is in use.

Figure 4:
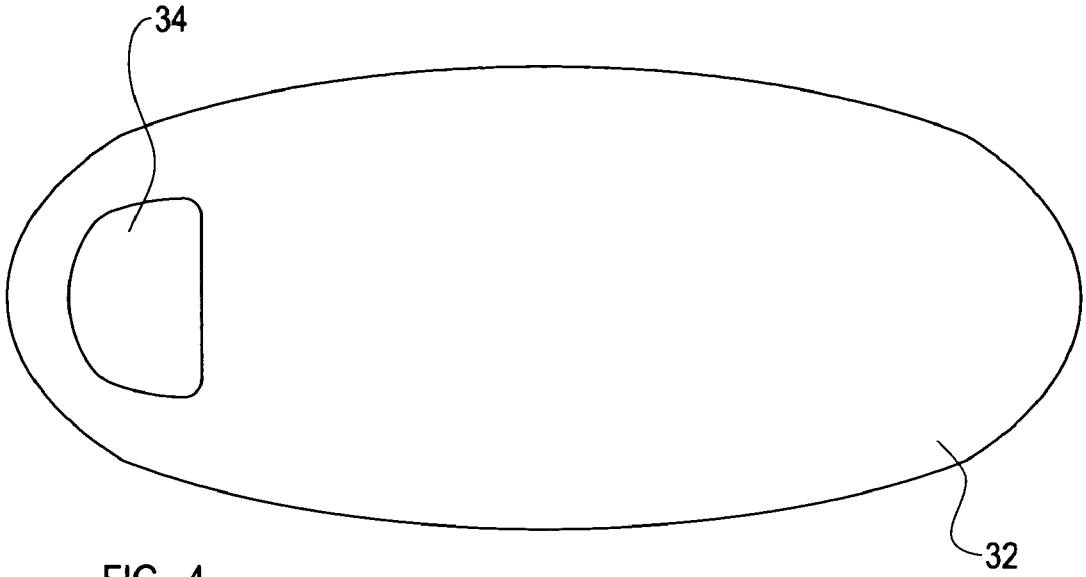
FIG. 4 is a plan view of an insert for the saddle of FIGS. 1 to 3.
Figure 5:
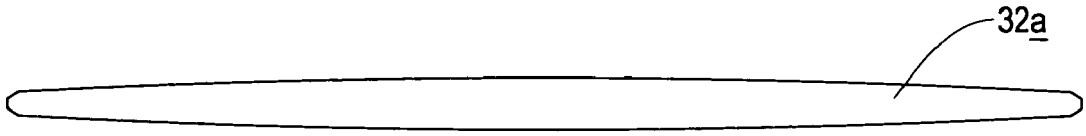
FIGS. 5 and 6 are end views of different thickness inserts for the saddle of FIGS. 1 to 3.
Figure 6:
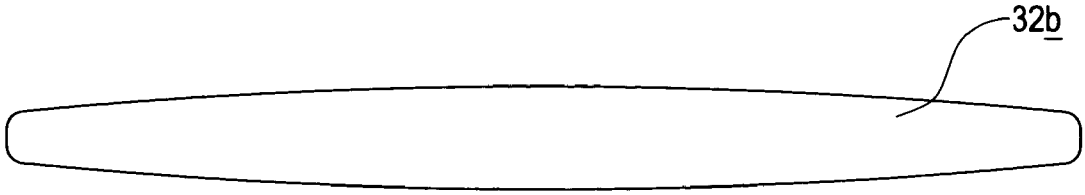

Inserts 32, such as those illustrated in FIGS. 4 to 6 are provided for insertion into the upwardly extending pockets 28. Each insert 32 is of a generally oval shape, as shown in FIG. 4, and has a greatest thickness along a middle portion thereof as best seen in FIGS. 5 and 6, with the thickness tapering towards the edges. Preferably a number of inserts 32 of different thickness' is provided, for example a thinner one 32*a* and a thicker one 32*b*. The inserts 32 may be formed from any appropriate substantially incompressible material, which may for example be a slightly flexible plastics material.

The inserts 32*a*, 32*b* may, for example, be of the order of 160 mm long and 70 mm wide with thickness' in their middle portions of 7 mm and 15 mm respectively. Clearly, however, the dimensions of the inserts 32 will depend on the exact design and size of saddle with which they are intended to be used and the changes in fit which they are designed to achieve.

It will be appreciated that many other general shapes of inserts may also be used. For example, they may be generally rectangular in shape rather than oval. They may also or additionally be generally flat, rather than tapering towards the edges, with radiused corners to avoid any hard edges. In another alternative the inserts may be generally flat on one side (intended in use to be adjacent the underside of the tree point) and tapering on the other side (intended in use to be towards the underside of the saddle).

The inserts are conveniently (although not necessarily) provided with a formation, for example a loop type formation 34, which may be formed integrally with the main part of the insert 32 as shown in FIG. 4, or added to it later. In the latter case the loop type formation may for example be formed of a flexible fabric material, such as webbing. The purpose of the loop type formation 34 is to assist in removing the inserts 32 from the upwardly extending pockets 28 when required.

Figure 2:
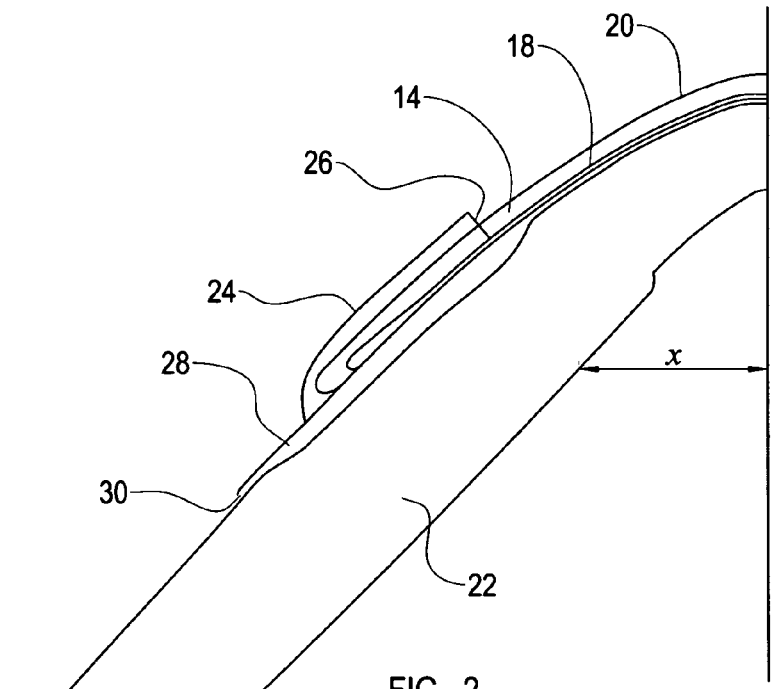
FIG. 2 is a section through one side of the saddle along line A—A of FIG. 1 without any insert in the upwardly extending pocket.
Figure 3:
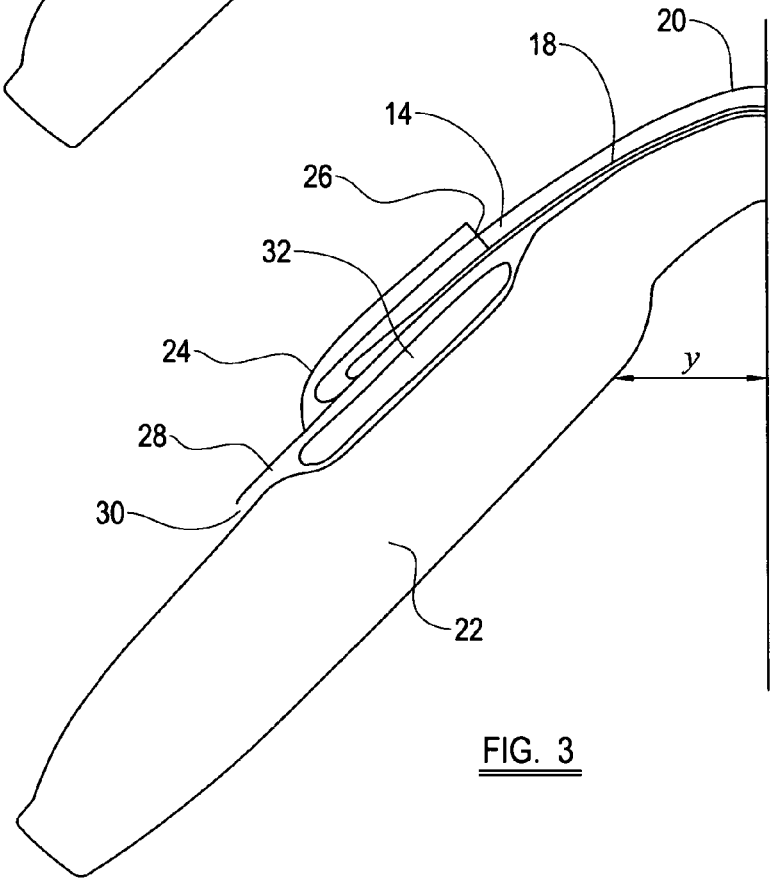
FIG. 3 is a section through one side of the saddle along line A—A of FIG. 1 with an insert in the upwardly extending pocket.

In FIG. 2 the upwardly extending pocket 28 is empty and the width of the gullet can be seen to be "x". In FIG. 3 an insert 32 has been placed into the upwardly extending pocket 28, and is thus located between the tree point 14 and the stuffed panel 22. As a result the padding in the stuffed panels 22 has been pushed inwardly with respect to the tree point 14 and the width of the gullet is now "y", which is significantly smaller in magnitude that "x". The fit of the saddle 10 has thus been altered from, for example a wide to a medium, depending on the thickness of insert used.

It will be quite clear that multiple inserts may be used together in place of single inserts 32, however, if this is intended then the degree of tapering towards the edges of the inserts would be reduced to ensure a large contact area between them and to prevent them rocking with relation to each other.

Figure 7:
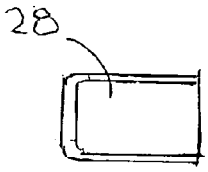
FIGS. 7 and 8 show different orientations for the pocket.
Figure 8:
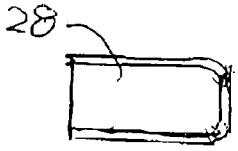

The pockets 28 are upwardly extending and have downwardly facing openings 30, but all that is required is that it is readily possible to insert and remove the inserts 32 from the pockets 28. Thus the pocket 28 could extend rearwardly from a forward facing opening (FIG. 7), or forwardly from a rearward facing opening (FIG. 8).

The pockets 28 are provided on a surface of the saddle 10 which is accessible when the saddle 10 is in use on a horse, hence it is on an outer accessible surface of the saddle. This ensures that the surface of the saddle 10 which is against the horse in use has no openings that could cause abrasions, and means that inserts 32 can be changed while the saddle 10 remains on the horse.

It should be appreciated that the present invention is not thought to be suitable for use in Western style saddles, but rather only in European style saddles.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A horse riding saddle including a tree with a downwardly extending point on each side of the saddle adjacent a front thereof, the saddle comprising:

a pocket on an outer accessible surface on each side of the saddle, the pocket extending underneath the respective point of the tree and having an opening; and an insert having a thickness and insertable into the pocket to enable the saddle to fit different sizes of horses.

2. The saddle of claim 1, wherein the pocket is upwardly extending, and wherein the opening faces downwardly.

3. The saddle of claim 1, wherein the pocket is rearwardly extending, and wherein the opening faces forwardly.

4. The saddle of claim 1, wherein the pocket is forwardly extending, and wherein the opening faces rearwardly.

5. The saddle of claim 1, and a closure for opening and closing the pocket to retain the insert therein.

6. The saddle of claim 5, wherein the closure is opened and closed without the aid of tools.

7. The saddle of claim 5, wherein the closure includes a hook and loop fastener.

8. The saddle of claim 1, and additional inserts having different thicknesses, a selected one of the inserts being insertable in the pocket.

9. The saddle of claim 8, wherein the inserts are constituted of a substantially incompressible material.

10. The saddle of claim 9, wherein the material from which the inserts are constituted is slightly flexible.

11. The saddle of claim 8, wherein the inserts are constituted of a plastics material.

12. The saddle of claim 8, wherein each insert has a generally oval shape with a middle portion having the greatest thickness, each insert tapering in thickness towards its edges.

13. The saddle of claim 12, wherein the middle portion of each insert is located directly under the respective point of the tree.

14. The saddle of claim 8, and a formation at a lower end of each insert to assist in its removal from the pocket.

15. The saddle of claim 14, wherein the formation has loops integrally formed on a main portion of the respective insert.

16. The saddle of claim 14, wherein the formation on each insert has loops secured to a main portion of the respective insert.

17. The saddle of claim 16, wherein each loop is formed of a flexible fabric.

* * * * *